United States Patent [19]

Woltman

[11] Patent Number: 5,050,327

[45] Date of Patent: Sep. 24, 1991

[54] RETROREFLECTIVE SIGN HAVING IMPROVED LEGIBILITY

[75] Inventor: Henry L. Woltman, St. Paul, Minn.

[73] Assignee: Minnesota Mining and Manufacturing Company, St. Paul, Minn.

[21] Appl. No.: 438,691

[22] Filed: Nov. 17, 1989

[51] Int. Cl.[5] ..... G09F 13/16

[52] U.S. Cl. ..... 40/582; 40/615; 350/101

[58] Field of Search ..... 40/582, 903, 615; 350/101, 103, 109

[56] References Cited

U.S. PATENT DOCUMENTS

| | | | |
|---|---|---|---|
| 3,790,431 | 2/1974 | Tung | 40/615 X |
| 3,802,944 | 4/1974 | Tung | 40/615 X |
| 3,934,065 | 1/1976 | Tung | 350/109 X |
| 4,215,501 | 8/1980 | Meijer | 40/582 X |
| 4,250,646 | 2/1981 | Trachtenberg | 40/582 |
| 4,726,134 | 2/1988 | Woltman | 40/582 |

OTHER PUBLICATIONS

ASTM D 1003-61, pp. 17-24.

*Primary Examiner*—Kenneth J. Dorner
*Assistant Examiner*—J. Bonifanti
*Attorney, Agent, or Firm*—Gary L. Griswold; Walter N. Kirn; Robert H. Jordan

[57] ABSTRACT

A sign having a face bearing an informational legand thereon, the face comprising at least one legend portion and at least one background portion, and the sign comprising at least one legend segment and at least one background segment, which segments are defined by the legend and background portions, wherein at least part of at least one of the legend and background segments is retroreflective and translucent. The segments of the signs which are translucent and retroreflective exhibit increased luminance under adverse lighting conditions, thereby increasing the conspicuity and legibility of the sign.

20 Claims, 1 Drawing Sheet

RETROREFLECTIVE SIGN HAVING IMPROVED LEGIBILITY

FIELD OF INVENTION

The present invention relates to retroreflective signs such as are used for controlling motor vehicle traffic.

BACKGROUND

Many signs located along the sides of highways and other roads are required to be at least partially retroreflective in order to make the signs more easily detectable and legible, particularly at night, to operators of vehicles approaching the signs. The legend on such signs is typically of a contrasting color to that of the background so as to improve the legibility of the information displayed thereon. A common construction for such signs is to mount retroreflective sheeting used in the face of the sign upon a rigid member, e.g., a supporting panel of aluminum, wood, or other rigid substrate.

During daylight hours, the legibility of such signs is typically optimum under conditions where the sun is substantially to the driver's back or at another angle, e.g., overhead, such that the sign is illuminated without subjecting the driver's eyes to substantial glare. Similarly, at night the legibility of such signs is typically optimum when the predominant lighting is that provided by the headlights of the driver's own vehicle or other vehicles traveling in substantially the same orientation to the sign, e.g., those vehicles traveling in the same direction as, and directly ahead of or behind, the subject driver's vehicle. However, in daytime conditions where the sun and sign are disposed so that the sign is backlit by the sun or where the environment behind the sign is one of bright haze, the face of the sign may be effectively shadowed so as to substantially impair the legibility of the sign. In many instances, the face of the sign may be rendered virtually illegible at useful distances, i.e., those distances at which the legend is to be read, referred to in U.S. Pat. No. 4,726,134 (Woltman) as the legibility zone, even when the legend and background are of substantially contrasting colors, e.g., black letters on white background. Similar interference can occur at night in instances where a sign is backlit by the headlights of oncoming traffic on the same or nearby roads, or by light sources having locations in close proximity with respect to the sign, e.g., street lights. In some instances, a conventional opaque sign may be essentially illegible and be perceived as only a silhouette.

SUMMARY OF INVENTION

The present invention provides a sign having retroreflective properties which offers improved legibility under adverse lighting conditions, such as where the sign is brightly backlit, e.g., by the sun during daylight hours or by the headlights of an oncoming vehicle during nighttime hours.

Briefly summarizing, signs of the present invention have a face bearing an informational legend thereon, e.g., a speed limit, navigational information, etc., the face being made up of one or more legend portions and one or more background portions. The legend portions and background portions of the face of the sign define cross-sectional segments of the sign referred to herein as the legend segments and background segments, respectively. At least part of at least one of the legend segment or background segment is both retroreflective and translucent. By retroreflective it is meant that the subject segment of the sign will reflect a substantial portion of the light incident to the front surface thereof, i.e., the face of the sign, substantially back toward the source of the light. By translucent it is meant that the subject segment will transmit a substantial portion of the light which is incident to the back surface thereof, i.e., the back side of the sign. For instance, a translucent segment will transmit sufficient amounts of ordinary daylight such that the portion of the face of the sign which is presented by the subject segment is visibly brighter or more luminous to an observer. Typically the legend and background portions of the face are of contrasting colors to enhance the legibility of the information displayed on the sign. For instance, many speed limit signs comprise a black legend on a white background. In some embodiments, both the legend and background portions are retroreflective.

When viewed under daytime conditions where the sun is to the observer's back or substantially overhead, or at night when observed by the driver of a vehicle the headlights of which are illuminating the face of the sign and providing a substantial portion of the illumination visible to the observer, signs of the invention have a substantially conventional appearance. However, under conditions such as where the signs are backlit by the sun or headlights of oncoming vehicles, or are viewed against a bright haze, legends on the faces thereof will have increased conspicuity and legibility relative to conventional opaque signs. Increased conspicuity and legibility are achieved in accordance with the present invention because at least part of at least one of the background or legend segments of the sign is translucent, thereby providing improved luminance, as well as having a retroreflective face portion. The improved luminance visually enhances the conspicuity and contrast between the legend and background portions, thereby permitting the legend to be read more easily. For instance, a speed limit sign may be made with a black, substantially opaque, legend and a white, retroreflective and translucent, background such that under conditions when the sign is backlit, the background portion of the face will tend to be brighter in appearance while the legend remains dark, thereby providing greater contrast between the legend and background under such viewing conditions than was heretofore achieved.

BRIEF DESCRIPTION OF DRAWING

The invention will be further explained with reference to the drawing, wherein.

These figures, which are idealized, are not to scale and are intended to be merely illustrative and not limiting.

DETAILED DESCRIPTION OF INVENTION

As summarized above, the present invention provides a sign having a face which comprises a legend portion and a background portion, such portions defining legend and background segments wherein at least part of at least one of the legend segment or the background segment is both retroreflective and translucent. Typically, it is preferred that the other segment of the sign be substantially opaque, however, if desired, in some embodiments both the legend and background segments can be translucent. As will be understood by those skilled in the art, a sign of the invention may comprise one or more legend segments and one or more background segments.

Figure 1:
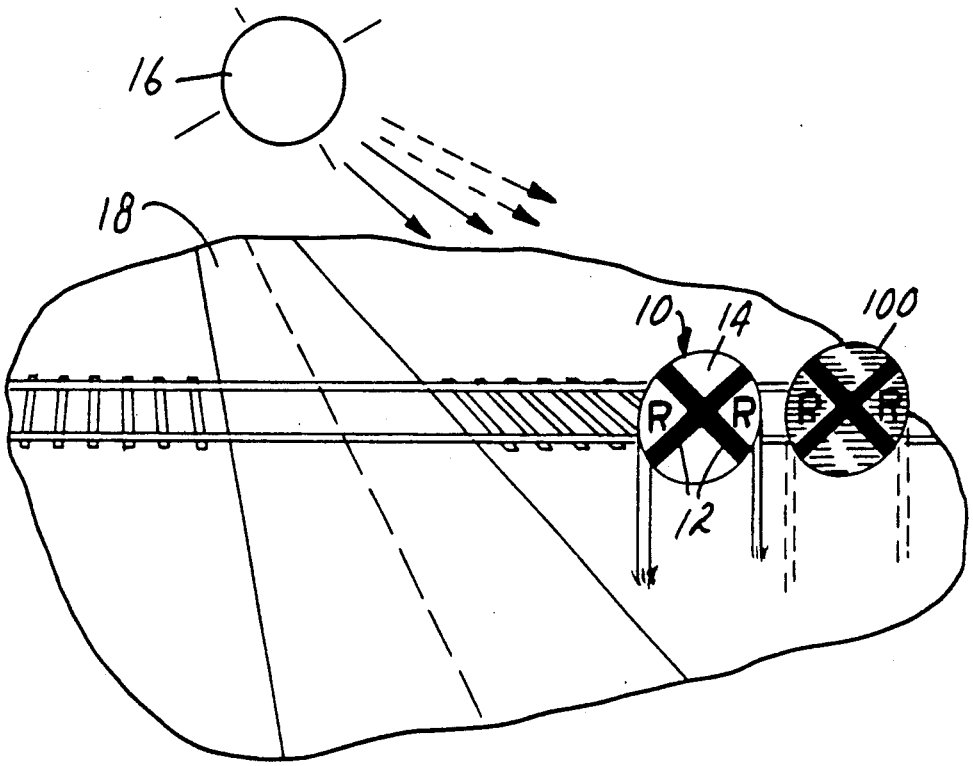
FIG. 1 is a perspective view of a road side setting illustrating the relative legibility of a sign of the invention and a conventional sign under backlit conditions.

An illustrative embodiment of a sign of the present invention is shown in FIG. 1. Sign 10 of the invention comprises opaque legend segment 12 and retroreflective and translucent background segment 14. When backlit by sun 16, sign 10 offers improved legibility to the occupants of a vehicle (not shown) traveling along road 18 approaching the face of the sign because background segment 14 exhibits greater luminance than does legend segment 12.

In contrast, conventional sign 100, which bears a face having the same information displayed thereon as does sign 10, but which is completely opaque, offers relatively impaired legibility and conspicuity when viewed at the same viewing angle. When backlit as shown, sign 100 may be visible merely as a silhouette to the occupants of an approaching vehicle.

In a typical embodiment of a sign of the present invention, either the legend segment(s) are substantially opaque and the background segment(s) are both retroreflective and translucent, or the legend segment(s) are retroreflective and translucent and the background segment(s) are substantially opaque. Depending upon the desired embodiment, only the translucent segment(s) may be retroreflective or both the translucent and opaque segments may be retroreflective. In other embodiments, the legend and background segments are each translucent, with one or both of the legend and background portions being retroreflective.

The legend and background portions may be of desired color, typically preferably of legibility-enhancing contrasting color. Depending upon the embodiment, at least part of the background portion may be, for instance, white, blue, brown, orange, yellow, red, or green. If desired, at least part of the translucent segment may be fluorescent. The background and legend colors for many applications are subject to official conventions, e.g., U.S. speed limit signs typically have black legends and white backgrounds.

The portion or portions of the face of the sign which are retroreflective are typically covered with retroreflective material, often in the form of a sheeting. Although the term "retroreflective sheeting" is used herein, it will be understood that other kinds of retroreflective materials, e.g., retroreflective coatings, having the properties taught herein can be used to form the retroreflective portions of signs of the invention.

Typically, retroreflective sheetings used in traffic control signs conform to specified standards for daytime color, retroreflective angularity and brightness, and durability as well as certain other characteristics as mandated for the intended application. For example, the U.S. Department of Transportation, Federal Highway Administration has published standards for retroreflective sheeting in its Federal Projects FP-85 manual, and the Federal Supply Service of the General Services Administration has published standards for retroreflective sheeting in Federal Specification L-S-300C. Typically, retroreflective sheetings used in signs of the invention will conform to one or more of the criteria in such standards.

Retroreflective sheetings used in the signs provided herein preferably provide high retroreflective brightness. Typically, retroreflective sheetings used herein will provide a retroreflective brightness of at least about 1, preferably at least about 5, and more preferably at least about 50 candela per lux per meter$^2$ at an observation angle of 0.2° and an entrance angle of −4°. In some embodiments, the retroreflective portion will exhibit substantially higher retroreflective brightnesses, achieving brightnesses of at least about 100 or even about 1000 or more candela per lux per meter$^2$ at an observation angle of 0.2° and an entrance angle of −4°.

Retroreflective sheetings used in the translucent segments of the sign will typically be such that effective transmittance of the translucent segment is at least about 0.01, preferably at least about 0.02, and more preferably at least about 0.05. Effective transmittance is used herein to refer to the overall transmittance of the subject segment of the sign, including the retroreflective material on the face thereof, backing member if any, and any other layers or members in the cross-section of that portion, e.g., adhesive(s) used to bond elements of the sign together. As used herein, transmittance refers to Luminous Transmittance as determined in accordance with ASTM D1003-61, Procedure B using a recording spectrophotometer.

In many instances, the transmittance of the legend segment is preferably at least 10 percent different from that of background segment so as to improve legibility under adverse "back-lit" conditions. Legibility under such conditions will also be dependent in part upon the degree of contrast in color between the legend and background segments.

An illustrative example of a retroreflective sheeting which may be used in the retroreflective and translucent segments of signs of the present invention is SCOTCHLITE Brand Diamond Grade 3970 G Series Retroreflective Sheeting which is available from the Minnesota Mining and Manufacturing Company. Such sheeting will typically exhibit a retroreflective brightness in excess of 100 to 200 candela per lux per meter$^2$ at an observation angle of 0.2° and an entrance angle of −4°. The transmittance of several commercially available retroreflective sheetings were found to be as follows:

| Material | Haze (%) | Thickness (mils/microns) | $T_t$* | $T_d$** |
|---|---|---|---|---|
| 3900 DG[1] | 96.11 | 20.5/0.61 | 0.919 | 0.8833 |
| 3900 DG White[2] | 99.19 | 20.0/0.60 | 0.211 | 0.2093 |
| 3900 DG Blue[3] | 99.60 | 21.5/0.65 | 0.0254 | 0.0253 |
| 3800 HI White[4] | 96.29 | 11.0/0.33 | 0.0054 | 0.0052 |

*Total Luminous Transmittance
**Diffuse Luminous Transmittance
[1]SCOTCHLITE Brand Diamond Grade Retroreflective Sheeting 3900 Series with clear seal film.
[2]SCOTCHLITE Brand Diamond Grade Retroreflective Sheeting 3900 Series with white seal film.
[3]SCOTCHLITE Brand Diamond Grade Retroreflective Sheeting 3900 Series with white seal film and blue cover film.
[4]SCOTCHLITE Brand High Intensity Retroreflective Sheeting 3800 Series with white binder layer.

In general, any retroreflective sheeting which is also transulucent to light incident to the rear side thereof will be of utility in the present invention.

Figure 2:
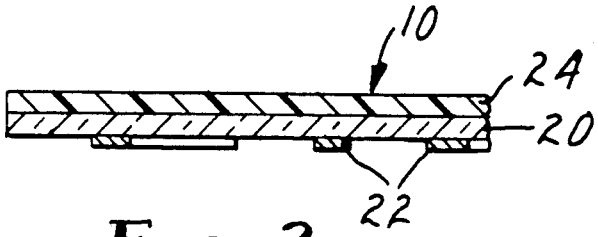
FIG. 2 is a cross-sectional view of an illustrative embodiment of a sign of the invention.

Typically, a sign of the invention will also comprise a backing member on which the face is mounted. Such members can be used to impart desired strength and shape characteristics to the sign. Referring to FIG. 2, therein is illustrated sign 10 which comprises retroreflective sheeting 20 which forms the background portion of the sign face and an opaque material 22 such as black paint or screen processed ink applied thereon to provide the legend portion of the sign face. Sheeting 20 is bonded to backing member 24 such as with adhesive (not shown).

Backing member 24 should typically be sufficiently strong and dimensionally stable to support of the sign, and particularly the face thereof, in its desired shape and configuration, typically planar, under the environmental conditions to which the sign is expected to be subjected. Illustrative examples of some environmental conditions which must typically be taken into consideration when selecting a backing member for a sign of the invention include expected ranges of wind, precipitation, exposure to sunlight, temperature, and humidity, as well as the likelihood of presence of corrosive or other deleterious agents. Another factor which should be considered when selecting a backing member is the manner in which the sign is to be used. For instance, it may be more critical to construct a sign having a low total weight if the sign is intended to be moved frequently than in the case of a sign which is intended to be mounted in a single location for an extended period of time.

The backing member of a sign of the invention must be translucent or transparent in at least any segment of the backing member which is part of the translucent segment of the sign. For instance, if the background segment is translucent, the segment of the sign's backing member which is behind the background portion of the sign face must be translucent. Accordingly, the aluminum panels which are solid, i.e., substantially continuous, and coextensive with the substantially the entire face of the sign that are typically used on conventional signs could not be used in a sign of the invention. Instead, such panels would need to be shaped or cut out in those areas which would be part of the translucent segments of the sign. Depending in part upon the shape of the translucent segments and nontranslucent segments (if any) of the sign, an aluminum panel shaped in accordance with the translucent segments might not be capable of providing desired support to the sign.

In many embodiments of the invention, the backing member is preferably a translucent polymeric material which can simultaneously provide support to the entirety of the sign face, i.e., is substantially coextensive therewith, while permitting light incident to the rear side thereof to be transmitted therethrough in accordance with the present invention. Many such materials can be made with the desired combination of strength and optical properties. Some illustrative examples of polymeric materials which can be used in signs of the invention include, but are not limited to, polycarbonates, polymethylmethacrylates, modified acrylics, e.g., acrylics modified with vinyl, acetate, styrene, fiberglass, or other fillers, polyesters, and epoxies.

Typically, the backing member will consist of a transparent clear or translucent white polymeric material. Signs of the invention made with translucent white backing members tend to exhibit brighter colors when a bright source of light illuminates the face of the sign, and thus are typically preferred in instances where such illumination is expected. It is believed that in such instances, the translucent backing member serves to mask the non-white color of light reflected from objects behind the sign, e.g., wooded hillsides. When a bright source of light illuminates the side of the sign or the rear of the sign, both transparent and translucent backing members will typically provide high performance. However, under such illumination, translucent backing members may tend to provide a diffusing effect that typically tends to impart a more uniform, and thus more legible, appearance to the face of the sign than that achieved with transparent backing members. As will be understood, selection of a backing member with optimum characteristics for a sign for a particular location will be dependent in part upon the lighting conditions under which the sign is to be viewed, particularly the most common prevailing mode of illumination, the features of the area surrounding the sign, particularly those within the field of view when the sign is under observation, and the transmissive characteristics of the retroreflective material used in the translucent segments of the sign.

If desired, in some instances the backing member of a sign of the invention may optionally further comprise a coloring agent, e.g., pigment or dye, to impart desired color to the backing member so as to impart a desired color or appearance to the translucent segment of the sign. Another method of imparting color to the translucent segment of the sign is to incorporate a coloring member, e.g., a colored film, in the sign. Such member can be placed between the face and backing member or behind the backing member to prevent any interference with the desired retroreflection provided by the translucent portion of the face of the sign. Alternatively, the coloring member could be placed in front of the face of the sign. In the latter instance, the coloring member is preferably of very high transmittance and should be selected so as to not interfere undesirably with the optical relationships necessary for retroreflection. If desired, at least part of the translucent segment of the sign may be fluorescent, e.g., provided by incorporation of a fluorescent pigment or dye in the backing member or in an optional coloring member. As will be understood by those skilled in the art, the optimum selection of formulation, color and location of a coloring agent or member in a sign of the invention may be readily determined by trial and error.

Typically, it is preferred that the backing member and any other elements within the translucent segments of the sign be white rather than colored. In incidences where such elements are colored, the translucent portion of the face of the sign, i.e., the legend and/or the background, depending upon the particular embodiment, may tend to exhibit a more grayish appearance which may render the appearance of the sign less desirable or may even tend to impair the legibility or conspicuity thereof.

Many conventional signs are mounted on a single pole located behind the face of the sign substantially near the middle thereof. As will be understood, however, it will typically be preferred that signs of the invention be mounted on a support in an optically-non-interfering manner. What is meant by "optically-non-interfering manner" is that the support is not located behind translucent portions of the face of the sign in a manner that might tend to interfere with transmission through the sign of light which is incident to the rear side of the sign. Illustrative examples of different manners which may be useful to mount signs of the invention include using (1) supports connected to the sign and disposed behind it only at its periphery, e.g., two posts or supports, one on either side of the sign, or (2) one or more posts or supports adapted to extend behind only the non-translucent portions of the face of the sign.

Figure 3:
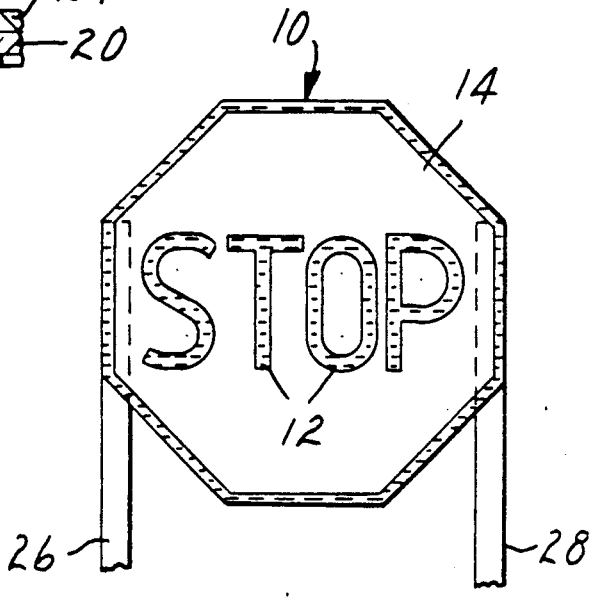
FIG. 3 is a plan view of another illustrative embodiment of a sign of the invention comprising a non-interferingly-mounted support.

FIG. 3 illustrates a sign of the invention mounted in a substantially optically-non-interfering manner. Shown therein is sign 10 which has opaque legend segment 12 and retroreflective translucent background segment 14. Supports 26 and 28 are disposed at the sides of background segment 14, i.e., at the periphery thereof. When mounted in such a manner, even when supports 26 and 28 are opaque, e.g., as are steel poles, they will not block light incident to the rear side of sign 10 in a manner which substantially reduces the luminance of background segment 14 so as to impair the legibility of sign 10.

EXAMPLE

The invention will be further explained by the following illustrative example.

Two signs were prepared. Sign A was made in accordance with the present invention and comprised SCOTCHLITE Diamond Grade Brand Retroreflective Sheeting 3790 adhered to a transparent polymeric backing member with a legend formed thereon with opaque ink.

Sign B was of conventional construction and comprised the same kind of retroreflective sheeting used in Sign A adhered to the surface of an opaque aluminum panel which was substantially coextensive with the sheeting. A legend was formed thereon in the same manner as was done for Sign A.

Signs A and B were then mounted adjacent one another and observed under the following conditions:

(1) nighttime viewing conditions where the signs were illuminated by substantially only the headlights of the observer's car;

(2) mid- and late-afternoon daytime conditions with the sun shining on the faces of the signs, i.e., "frontlit"; and (3) mid- and late-afternoon daytime conditions with the sun shining on the rear of the signs, i.e., "backlit".

The luminance (in candelas per meter$^2$) of the background portions of the signs were as follows:

TABLE I

| Conditions | Sign A | Sign B |
|---|---|---|
| Nighttime** | 101 | 101 |
| Daytime* - Frontlit | | |
| 3:30 PM | 14,500 | 12,900 |
| 5:10 PM | 15,900 | 15,600 |
| Daytime* - Backlit | | |
| 3:30 PM | 7,500 | 3,400 |
| 5:10 PM | 7,200 | 2,700 |

*April 10 in Minnesota.
**Low beam headlights at distance of 400–600 feet, equal distance in both cases.

These results illustrate that, under nighttime conditions when the signs are not backlit, signs of the invention exhibit similar properties as do conventional signs. Under daytime conditions with the signs being frontlit by the sun at a high elevation, signs of the invention exhibit somewhat greater luminance than do conventional signs. Accordingly, under such conditions, signs of the invention will provide somewhat greater legibility than conventional signs. Under daytime conditions with the signs being frontlit by the sun at a lower elevation, i.e., in closer alignment with the configuration of illumination provided by vehicle headlights, signs of the invention exhibit slightly greater luminance than do conventional signs.

Under daytime conditions with the signs being backlit by the sun, signs of the invention exhibit substantially greater luminance than do conventional signs, to greater degree when the signs are backlit from a low elevation. Such greater luminance tends to make the signs more conspicuous and legible, thus increasing the effectiveness thereof.

Various modifications and alterations of this invention will become apparent to those skilled in the art without departing from the scope and spirit of this invention.

What is claimed is:

1. A sign located adjacent a road having a face bearing an informational legend thereon, said face comprising at least one legend portion and at least one background portion, each of said legend portions of said face defining a cross-sectional legend segment of said sign, said legend segment extending from said legend portion through the entirety of said sign, and each of said background portions of said face defining a cross-sectional background segment of said sign, said background segment extending from said background portion through the entirety of said sign, wherein at least one of said legend and background segments is both retroreflective and translucent such that light incident to the front surface of said retroreflective and translucent segment is retroreflected and light incident to the back surface of said retroreflective and translucent segment is transmitted through said front surface.

2. The sign of claim 1 wherein said translucent segment has a retroreflective brightness of at least about 1 candela per lux per meter$^2$ at an observation angle of 0.2° and an entrance angle of −4°.

3. The sign of claim 1 wherein said translucent segment has a retroreflective brightness of at least about 5 candela per lux per meter$^2$ at an observation angle of 0.2° and an entrance angle of −4°.

4. The sign of claim 1 wherein said translucent segment has a retroreflective brightness of at least about 50 candela per lux per meter$^2$ at an observation angle of 0.2° and an entrance angle of −4°.

5. The sign of claim 1 wherein said translucent segment has a retroreflective brightness of at least about 100 candela per lux per meter$^2$ at an observation angle of 0.2° and an entrance angle of −4°.

6. The sign of claim 1 wherein said translucent segment has a retroreflective brightness of at least about 1000 candela per lux per meter$^2$ at an observation angle of 0.2° and an entrance angle of −4°.

7. The sign of claim 1 further comprising a backing member.

8. The sign of claim 7 wherein said backing member comprises at least one of the following: polycarbonate, polymethylmethacrylate, modified acrylics, polyester, or epoxy.

9. The sign of claim 7 wherein said backing member comprises a coloring agent.

10. The sign of claim 1 wherein said legend and said background portions of said face are of legibility-enhancing contrasting colors.

11. The sign of claim 1 wherein at least a part of said legend portion is black.

12. The sign of claim 1 wherein at least a part of said background portion is at least one of white, blue, brown, orange, yellow, red, or green.

13. The sign of claim 1 wherein at least part of said translucent segment is also fluorescent.

14. The sign of claim 1 wherein the transmittance of said legend segment is at least 10 percent different from the transmissivity of said background segment.

15. The sign of claim 1 wherein the effective transmittance of said translucent segment is at least about 0.01 as determined in accordance with ASTM D 1003-61, Procedure B.

16. The sign of claim 1 wherein the effective transmittance of said translucent segment is at least about 0.02 as determined in accordance with ASTM D 1003-61, Procedure B.

17. The sign of claim 1 wherein the effective transmittance of said translucent segment is at least about 0.05 as determined in accordance with ASTM D 1003-61, Procedure B.

18. The sign of claim 1 mounted on a support in a substantially optically-non-interfering manner.

19. The sign of claim 1 further comprising a coloring member.

20. The sign of claim 7 wherein said backing member is translucent and white.

* * * * *